US008376522B2

(12) United States Patent
Oikawa et al.

(10) Patent No.: US 8,376,522 B2
(45) Date of Patent: Feb. 19, 2013

(54) LIQUID EJECTION HEAD AND PRINTING APPARATUS

(75) Inventors: Masaki Oikawa, Inagi (JP); Mitsuhiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 587 days.

(21) Appl. No.: 12/328,471

(22) Filed: Dec. 4, 2008

(65) Prior Publication Data

US 2009/0147057 A1 Jun. 11, 2009

(30) Foreign Application Priority Data

Dec. 6, 2007 (JP) ..... 2007-316436

(51) Int. Cl.
*B41J 2/05* (2006.01)

(52) U.S. Cl. ..... 347/61; 347/65

(58) Field of Classification Search ..... 347/61, 347/65

See application file for complete search history.

(56) References Cited

U.S. PATENT DOCUMENTS

| | | | | |
|---|---|---|---|---|
| 6,003,978 | A * | 12/1999 | Asakawa et al. | 347/65 |
| 6,244,693 | B1 * | 6/2001 | Misumi | 347/65 |
| 6,341,849 | B1 * | 1/2002 | Misumi | 347/65 |
| 6,540,336 | B2 * | 4/2003 | Kubota et al. | 347/65 |
| 6,588,887 | B2 * | 7/2003 | Ogawa | 347/65 |
| 6,663,229 | B2 | 12/2003 | Komuro et al. | |
| 6,976,748 | B2 | 12/2005 | Yabe et al. | |
| 6,984,025 | B2 | 1/2006 | Kaneko et al. | |
| 6,988,786 | B2 | 1/2006 | Kaneko et al. | |
| 7,066,581 | B2 * | 6/2006 | Conta et al. | 347/65 |
| 7,077,503 | B2 | 7/2006 | Kaneko et al. | |
| 7,108,352 | B2 | 9/2006 | Muraoka | |
| 7,172,264 | B2 | 2/2007 | Kaneko et al. | |
| 7,387,371 | B2 | 6/2008 | Oikawa | |
| 7,866,799 | B2 * | 1/2011 | Nabeshima et al. | 347/65 |
| 2003/0030702 | A1 * | 2/2003 | Komuro et al. | 347/65 |
| 2006/0284934 | A1 * | 12/2006 | Kim et al. | 347/61 |
| 2007/0040190 | A1 | 2/2007 | Kaneko et al. | |
| 2007/0176976 | A1 * | 8/2007 | Fujiwara | 347/65 |
| 2007/0291081 | A1 * | 12/2007 | Kanno et al. | 347/61 |
| 2008/0055368 | A1 | 3/2008 | Oikawa et al. | |
| 2008/0225086 | A1 | 9/2008 | Oikawa | |
| 2008/0239011 | A1 * | 10/2008 | Ide et al. | 347/61 |
| 2011/0025785 | A1 * | 2/2011 | Chung et al. | 347/61 |

FOREIGN PATENT DOCUMENTS

| | | |
|---|---|---|
| JP | 4-10941 | 1/1992 |
| JP | 2003-127399 | 5/2003 |
| JP | 2004-1488 | 1/2004 |
| JP | 2005-1379 | 1/2005 |

* cited by examiner

*Primary Examiner* — Charlie Peng

(74) *Attorney, Agent, or Firm* — Fitzpatrick, Cella, Harper & Scinto

(57) ABSTRACT

A liquid ejection head is provided that is adapted, when the ejection of comparatively small ink droplets by one print head is required, to not only increase a printing speed and a printing resolution but also to prevent the occurrence of cavitation. The liquid ejection head includes: nozzles, for which heaters are formed to generate thermal energy used to eject ink; and bubble generation chambers, for which ejection ports are formed for ejecting ink upon the application of thermal energy provided by the heaters. Further, a partition wall is formed in each bubble generation chamber at a position opposite the ejection port.

11 Claims, 12 Drawing Sheets

| | FLUID VECTOR DURING BUBBLE COLLAPSE | |
|---|---|---|
| WALL HEIGHT | DEGREE OF LOCALIZATION RELATIVE TO HEATER | STRENGTH FROM AIR SIDE TO SURFACE OF ELEMENT SUBSTRATE |
| NO WALL | STRONG; LOCALIZED AT ONE SPOT | VERY HIGH |
| 7μm | SMALL; SPREAD TO TWO | LOW |
| 14μm | SLIGHTLY SMALL; SPREAD TO TWO | SLIGHTLY LOW |

FIG.8

LIQUID EJECTION HEAD AND PRINTING APPARATUS

BACKGROUND OF THE INVENTION

1. Field of the Invention

The present invention relates to a liquid ejection head, for ejecting liquid droplets to print on a print medium, and to a printing apparatus, which employs the liquid ejection head.

2. Description of the Related Arts

Inkjet printing apparatuses that have so rapidly become popular are equipped with liquid ejection heads that, while being conveyed in the scanning direction, eject ink droplets and print on the print media. Advantages afforded by these inkjet printing apparatuses include the ease of design and the production of compact units and the ease of use when performing color printing.

Also, recently, in response to an increasing demand for inkjet printing apparatuses that provide better image quality, a present trend is for the number of heaters used as heat generation elements to be increased in order to perform faster printing using smaller liquid droplets. With this arrangement, since the current that flows to and through the heaters is increased, on the whole, a reduction in the power consumed wastefully by wiring is required. As one method for reducing the power consumed by wiring for carrying current to the heaters, resistance at the heaters may be increased, so that a large quantity of heat can be generated and applied to ink, even when only a small current is flowing across the heaters. Thus, the heaters may be formed by a thin film to reduce their cross-sectional sizes, and to increase their resistance to the transmission of electricity. However, in a case wherein, to heat ink, one heater is employed for each nozzle, there is a limitation on the acceptable reduction in the thickness of the film of the heaters, even when the heaters are formed by the thin film to increase their resistance. Therefore, an arrangement, such as that disclosed for an inkjet printing apparatus in Japanese Patent Laid-Open No. 2004-1488, wherein two or more heaters, arranged within a print head and electrically connected in series, may be employed in the above described case. In this instance, it is preferable that the interval between the heaters be as small as possible, so that the thermal energy generated by the heaters can be efficiently transferred to ink.

As a printing method to be employed by an inkjet printing apparatus, a dot density control method has been proposed whereby, for the expression of a half tone, the number of print dots in a unit area is controlled using print dots of a predetermined size. According to this method, a print head that includes nozzles having different ejection port diameters, and thus ejects ink droplets having different sizes, is employed as means for controlling the number of print dots. Then, print dots are formed by using small ink droplets for the bright portion and the intermediate portion of an image, while print dots are formed by using large ink droplets for the half tone portion and the dark portion of the image. A printing method performed in this way is proposed. As an example print head that includes nozzles that enable the ejection of ink droplets having different sizes, an arrangement wherein nozzles are alternately arranged in a zigzag pattern is a generally known means used to increase nozzle density and to provide a high resolution nozzle array. In Japanese Patent Laid-Open No. 2005-1379, a printing apparatus is disclosed that has a nozzle array obtained by arranging, in a zigzag pattern, nozzles that enable the ejection of ink droplets having different dot diameters.

By the way, a problem included in this inkjet printing apparatus is that inside a print head, cavitation occurs as bubbles collapse. To resolve this internal print head cavitation problem, an inkjet printing apparatus and a print head are disclosed, for example, in Japanese Patent Laid-Open No. H04-10941 (1992).

According to Japanese Patent Laid-Open No. H04-10941 (1992), this print head is formed such that the bubble generated during the ejection of ink droplets communicates with the air. Therefore, when the size of the bubble is reduced, the bubble is dispersed into the air, and does not remain within the print head. Thus, cavitation that occurs as the bubble collapses can be avoided, and damage to areas in the vicinities of the heaters can be prevented.

However, when a print head that includes a plurality of nozzles having ejection ports of different diameters is employed to cope with a request for faster printing or for higher image quality, as described above, it becomes difficult for the system that permits bubbles to communicate with the air to prevent the cavitation that occurs during the collapse of bubbles.

Even for the above described print head, wherein a plurality of nozzles that provide different ink ejection quantities are formed in a single substrate, the distance from the surface of a substrate to an ejection port must be the same for all the ejection ports, because of manufacturing requirements for producing the print head; however, the sizes of bubbles formed inside the print head vary, depending on the sizes of ejected ink droplets. And if a print head is designed to permit bubbles to communicate with the air, when an ink droplet is being ejected from a nozzle that provides a large ink ejection quantity, there is a difficulty that the bubble communicates with the air inside a nozzle for providing a small quantity of ink for ejection. Therefore, it is difficult for accurate printing to be performed using a print head that includes multiple nozzles having different ejection port diameters, and for the durability of the peripheral portions of the heaters to be improved.

As another reason that it is difficult to prevent the occurrence of cavitation, there is a case wherein the lengths of peripheral flow paths at the ejection ports of the print head, in a direction in which ink is ejected from a substrate to the wall face of the ejection ports, are extended in order to increase the printing speed. When the flow paths are formed in the nozzles in this manner, resistance to the flow of ink at the nozzles may be reduced while ink is supplied; however, when the length of a flow path to an ejection port from the substrate is extended for a nozzle that enables the ejection of a small ink droplet, employment of the arrangement that permits the bubbles to communicate with the air is more difficult.

As one other problem, when ink is ejected, the ink is generally divided into a main droplet and trailing sub-droplets, called satellites, and when a print head is formed so that bubbles communicate with the air, controlling the direction of ejected satellites is difficult. Furthermore, in accordance with recent developments in the study of small droplet formation during ejection, it has been found that satellites form into a mist and, as a result, the quality of a printed image is adversely affected by the low accuracy with which the satellites land. Thus, it may be concluded that means for improving the accuracy with which satellites land is required.

However, when the nozzles formed for a print head are designed to avoid the occurrence of cavitation by permitting bubbles to communicate with the air, the shapes of the bubbles are not stable and increasing the accuracy with which satellites land is difficult. Moreover, for a print head wherein heaters are alternately arranged in a zigzag pattern, and nozzles are arranged to permit bubbles to connect with the air, the low accuracy with which satellites land is especially obvious for a nozzle whose distance from an ink supply port is comparatively large.

SUMMARY OF THE INVENTION

While taking these problems into account, one objective of the present invention is to provide a liquid ejection head with which, when ink droplets having different quantities are ejected using the same print head, increases in the printing speed and in the resolution can be coped with and the occurrence of cavitation can be avoided, and a printing apparatus for which durability is improved by using this liquid ejection head.

In the first aspect of the present invention, there is provided a liquid ejection head comprising: nozzles, each of which include a heat generation element, for generating thermal energy used for ejecting a liquid, an ejection port, for ejecting the liquid to which thermal energy is applied by the heat generation element, and an energy application chamber, in which the heat generation element is arranged, wherein a partition wall is formed inside an area of the energy application chamber wherein the heat generation element is located.

In the second aspect of the present invention, there is provided a printing apparatus for performing printing using a liquid ejection head that comprises: nozzles, each of which include a heat generation element, for generating thermal energy used for ejecting a liquid, an ejection port, for ejecting the liquid to which thermal energy is applied by the heat generation element, and an energy application chamber, in which the heat generation element is arranged, wherein a partition wall is formed inside an area of the energy application chamber wherein the heat generation element is located.

According to the liquid ejection head provided by the present invention, since the flow of a liquid is generated along the partition wall formed inside the liquid ejection head, increases in the printing speed and in the resolution can be coped with, and the occurrence of cavitation, during the collapsing of bubbles, can be avoided. Therefore, the heat generation element can be protected from damage by the occurrence of cavitation, and the durability of the liquid ejection head improved. In addition, a printing apparatus can be provided that employs this liquid ejection head.

Further features of the present invention will become apparent from the following description of exemplary embodiments (with reference to the attached drawings).

BRIEF DESCRIPTION OF THE DRAWINGS

FIG. 8 is a table showing the simulation results obtained by comparing, based on the distance of the partition wall from the surface of the element substrate to the air side, the concentration levels of pressure waves on the face of a heater using the partition wall in FIGS. 4A to 4C, and by comparing the strengths of the pressure waves in a direction from the air to the element substrate;

DESCRIPTION OF THE EMBODIMENTS

A first embodiment for carrying out the present invention will now be described while referring to the accompanying drawings.

First Embodiment

<Schematic Arrangement of a Printing Apparatus>

Figure 1:
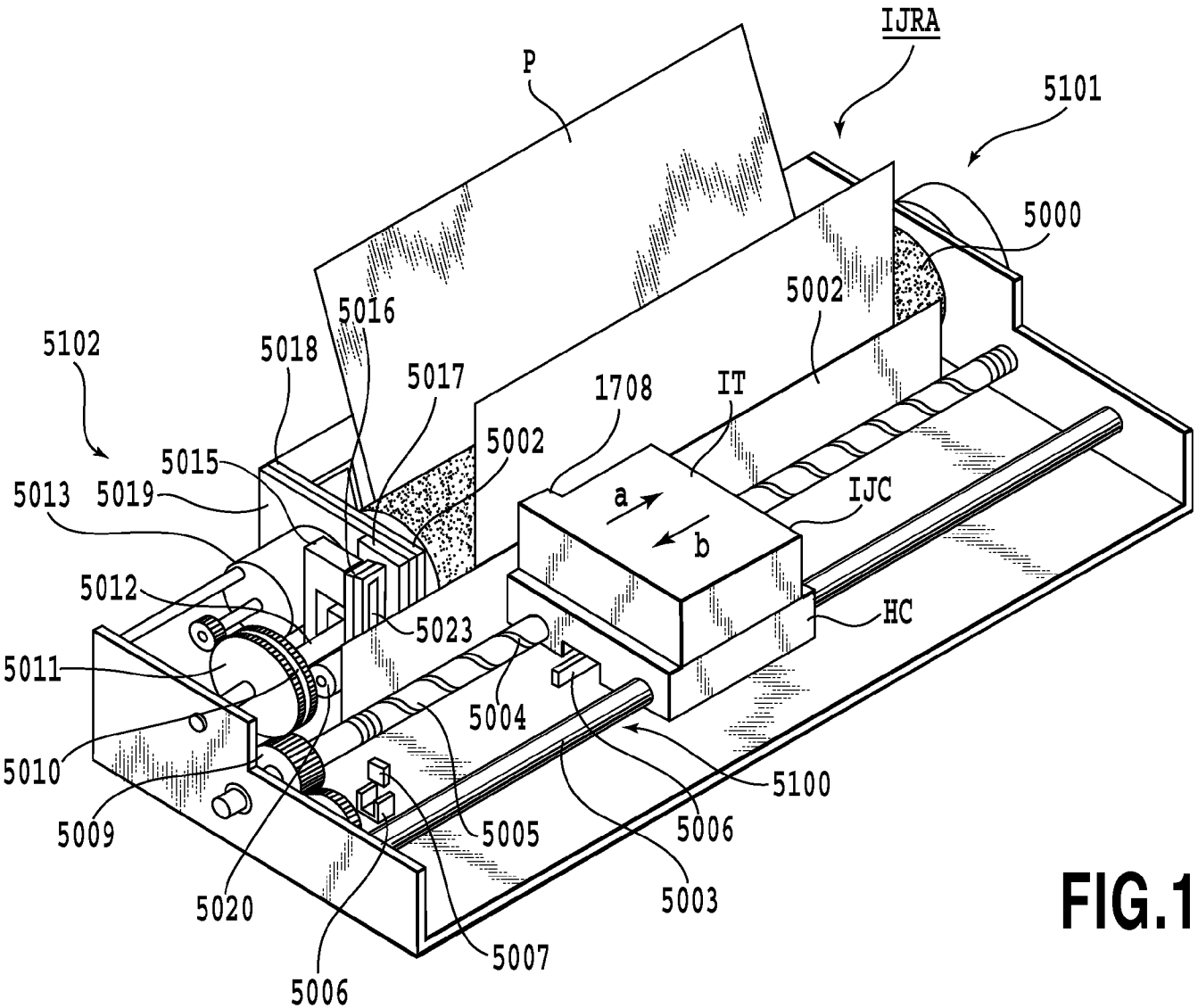
FIG. 1 is a perspective view of a printing apparatus, which employs a print head according to a first embodiment of the present invention, from which a cover has been removed.

FIG. 1 is a perspective view of an inkjet printing apparatus IJRA, which is a printing apparatus that a cover is removed and employs a print head 101 that serves as a liquid ejection head according to the present invention. The inkjet printing apparatus IJRA includes: the print head 101; a scanning mechanism 5100, for moving the print head 101; a conveying mechanism 5101, for conveying a printing medium P; and a recovery mechanism 5102, for effecting the recovery of the print head 101.

In this embodiment, the print head 101 and an ink tank IT, for ink storage, are integrally formed to provide an inkjet cartridge IJC. The inkjet cartridge IJC is mounted on a carriage HC.

The scanning mechanism 5100, which includes a drive motor 5013, rotates the lead screw 5005 by transferring thereto, via driving force transfer gears 5009, 5010 and 5011, a driving force provided by the drive motor 5013. A spiral groove 5004 is formed along almost the entire length of the outer wall of the lead screw 5005 in the direction in which extended, and the lead screw 5005, which passes through the carriage HC, is fitted on a spiral groove (not shown) that is formed inside the carriage HC. Thus, when the lead screw 5005 is rotated, the carriage HC, following along the spiral groove 5004, is moved for scanning. Furthermore, a guide rail 5003, along which the carriage HC is guided when moving, is also arranged so that it passes through the carriage HC. Therefore, when the carriage HC is moved, the scanning of the carriage HC is performed in directions, indicated by arrows a and b in FIG. 1, in which the guide rail 5003 is extended. In addition, photocouplers 5007 are home position detectors that detect the presence in a predetermined area of a lever 5006, provided for the carriage HC, and change the rotational direction of the drive motor 5013.

A printing medium P, on which ink is to be impacted as a printing liquid from the print head 101, is loaded in the conveying mechanism 5101. A pressing plate 5002 presses the printing medium P against a platen 5000 to maintain a constant distance between the printing medium P and the print head 101.

The recovery mechanism 5102 removes ink from the print head 101 using suction recovery to restore the print head 101, and includes a cap member 5022 and a suction device 5015. To use suction recovery, first, the cap member 5022, supported by a support member 5016, covers the front face of the print head 101. Then, suction supplied by the suction device 5015 is employed, via a cap opening 5023, to remove ink from the print head 101. A lever, which is used to start the suction recovery process, is located so that when the rotation of the lead screw 5005, which is accompanied by the movement of the carriage HC, is transferred to a cam 5020, the suction recovery process is initiated. At this time, the driving force generated by the drive motor 5013 that moves the carriage HC is transferred to the cam 5020, via a well known transfer mechanism, such as a clutch change mechanism, and controls the rotation of the cam 5020.

The recovery mechanism 5102 also includes a cleaning blade 5017 and a member 5019 that can reciprocate with the cleaning blade 5017 in the directions indicated by the arrows a and b in FIG. 1. When wiping is performed by the reciprocating cleaning blade 5017 while contacting the ejection port face of the print head 101, viscous ink or dust or the like, are removed from the face of the print head 101 wherein ejection ports are formed. The cleaning blade 5017 is not limited to the type illustrated, and another well known cleaning blade may be employed.

In this embodiment, when the carriage HC has reached the predetermined area at the home position, an appropriate process, either capping, suction recovery or cleaning, is performed at the position corresponding to the home position. These recovery processes may be also be performed at times other than when the carriage HC has reached the home position area, and the occasions where the recovery processes are performed are not limited to those described in the embodiment.

<Description of a Control Arrangement>

The control arrangement employed, for the above described printing apparatus, to perform the printing operation will now be described.

Figure 2:
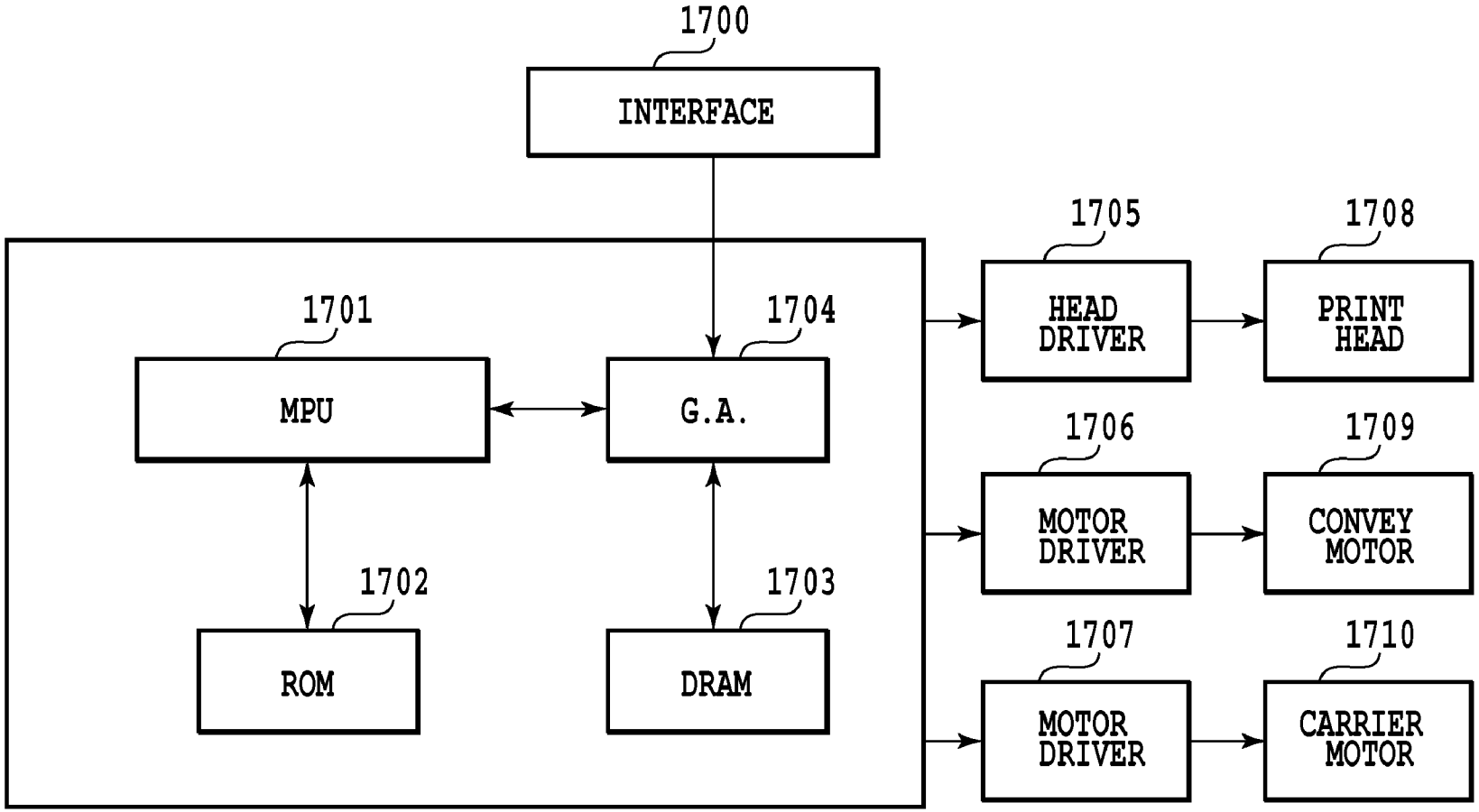
FIG. 2 is a block diagram showing the transfer of data and electric signals in the printing apparatus in FIG. 1.

FIG. 2 is a block diagram illustrating a circuit configuration for controlling the inkjet printing apparatus IJRA. Data flow within the inkjet printing apparatus IJRA is shown in the block diagram in FIG. 2. The inkjet printing apparatus IJRA includes an interface 1700, an MPU 1701, a ROM 1702 and a DRAM 1703. First, during the printing operation, the inkjet printing apparatus IJRA receives a print signal via the interface 1700, and then, the MPU 1701 executes a control program, which is stored in the ROM 1702, and stores the print signal and various types of data, such as print data to be transmitted to the print head 101, in the DRAM 1703.

The inkjet printing apparatus IJRA includes a gate array (G.A) 1704, which controls the supply of print data relative to the print head 101. The gate array 1704 also controls data transfers performed among the interface 1700, the MPU 1701 and the RAM 1703. In addition to the gate array 1704, the inkjet printing apparatus IJRA includes a carrier motor 1710, a conveying motor 1709, a head driver 1705 and motor drivers 1706 and 1707. The carrier motor 1710 is used to move the print head 101, via the carriage HC, for scanning. The conveying motor 1709 is used to convey the printing medium P. The head driver 1705 drives the print head 101. The motor drivers 1706 and 1707 drive the conveying motor 1709 and the carrier motor 1710, respectively.

The printing operation for which the above described control arrangement is used will now be described. When a print signal is received at the interface 1700, the print signal is converted, by the gate array 1704 and the MPU 1701, into print data that can be employed by the inkjet printing apparatus IJRA. Then, the motor drivers 1706 and 1707 are activated and, in accordance with the print data transmitted to the head driver 1705, the print head 101 is driven, via the carriage HC, and printing is performed.

<Description of a Print Head>

Figure 3:
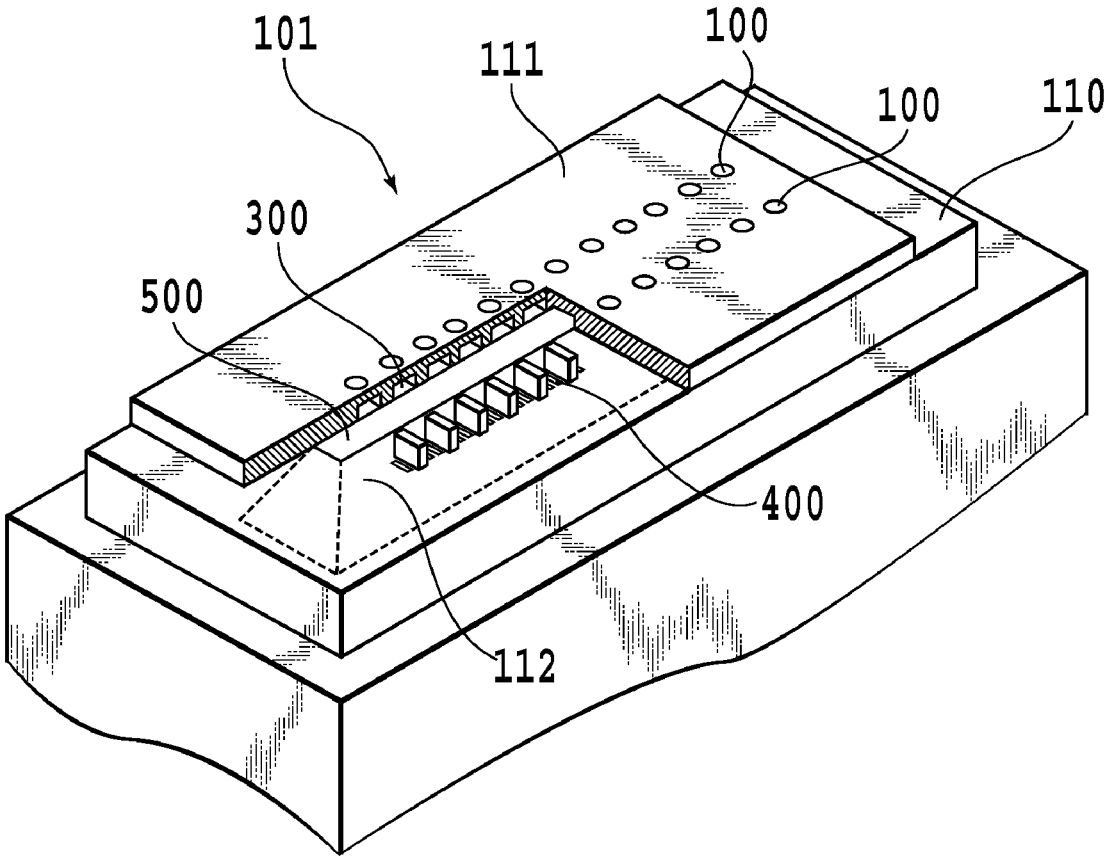
FIG. 3 is an enlarged, partially cutaway perspective view of the essential portion of the print head employed for the printing apparatus in FIG. 1.

The print head 101, provided as an inkjet print head for this embodiment, will now be described. FIG. 3 is a partially cutaway perspective view of the print head 101 of this embodiment. The print head 101 includes: an element substrate 110, which is a substrate on which are formed heaters 400 that serve as heat generation elements for ejecting ink; and an orifice plate (flow path formation substrate) 111, which is bonded to the element substrate 110. By pasting and bonding the element substrate 110 and the orifice plate 111 together, the print head 101 is obtained in which there are bubble generation chambers 200, which are defined as energy application chambers.

A plurality of ejection ports 100, for ejecting ink droplets, are formed in the orifice plate 111, as are ink flow paths 300 that communicate with the bubble generation chambers 200. In addition, a common liquid chamber 112 is defined in the orifice plate 111, and ink supplied through an ink supply port 500, which will be described later, is stored in the common liquid chamber 112 and is distributed to each ink flow paths 300. Generally, the ejection ports 100, the bubble generation chambers 200 and the ink flow paths 300 are collectively referred to as nozzles 600. In this embodiment, two arrays of ejection ports are arranged, in a zigzag pattern, on either side of a single ink supply port 500. The heaters 400 are embedded in the wall of the element substrate 110 that defines the internal space of the bubble generation chambers 200. When the heaters 400 are driven, bubbles are generated in the bubble generation chambers 200 and, using pressure supplied by the bubble generation, ink is ejected from the ejection ports 100.

As a liquid supply port, the ink supply port 500 is formed and passes through from the obverse surface of the element substrate 110, which contacts the orifice plate 111, to the reverse surface. The element substrate 110 is generally made of Si (silicon), although another material, such as glass, ceramics, a resin or metal, or the like, may be employed. The heaters 400, electrodes (not shown) for applying a voltage to the heaters 400 and wiring connected to the electrodes are provided, for the individual ink flow paths, on the obverse surface of the element substrate 110 using a predetermined wiring pattern. The heaters 400 are embedded in the obverse face of the element substrate 110 at locations corresponding to the ejection ports 100. And in addition, to improve the release of accumulated heat, an insulating film (not shown) is arranged on the obverse face of the element substrate 110 and covers the heaters 400. Moreover, a protective film (not shown) is overlaid on the insulating film arranged on the element substrate 110 to provide protection from cavitation, which will be described later, that occurs during the collapse of bubbles. The orifice plate 111, on the obverse side for the nozzles, is made, for example, of metal, polyimide, polysulfone or an epoxy resin.

The print head 101 includes nozzle arrays, formed of multiple nozzles 600, that are arranged, on either side of the ink supply port 500, in the same direction as that in which the ink supply port 500 is extended. The nozzles 600 of the nozzle arrays are arranged so that the pitch of one array is shifted to the pitch of another array. The pitches of these nozzle arrays may be shifted as needed, or may be aligned to arrange the nozzle arrays.

Figure 4A:
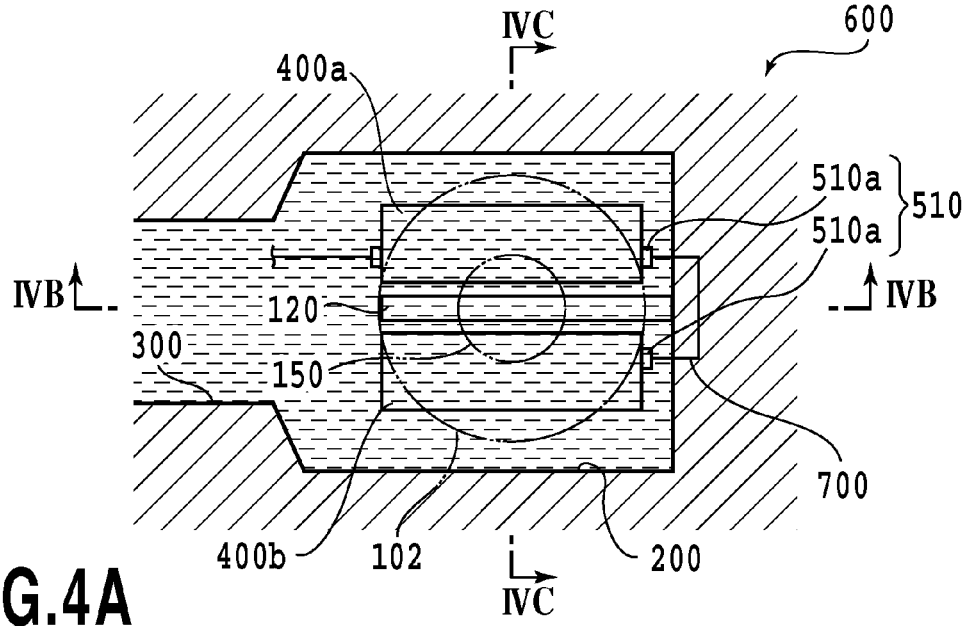
FIG. 4A is an enlarged cross-sectional view, taken in an ink ejection direction, of the essential portion of the print head in FIG. 3.
Figure 4B:
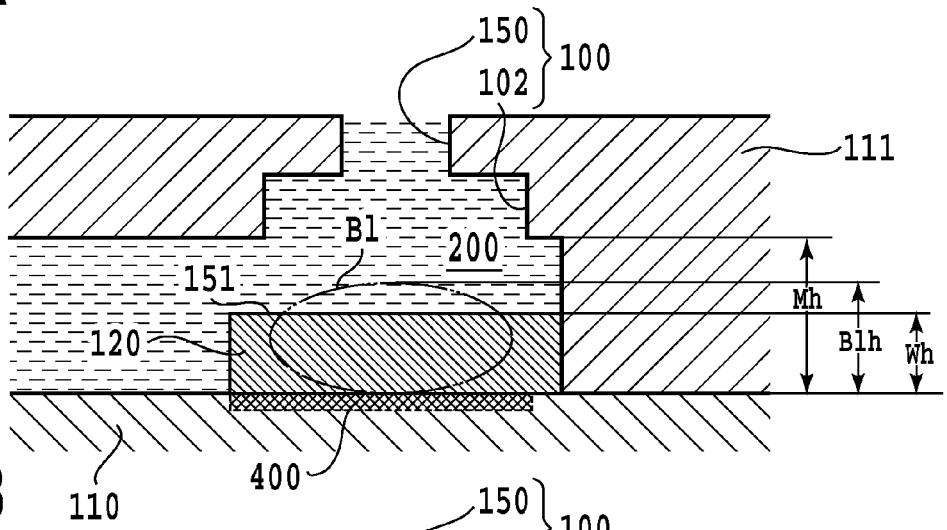
FIG. 4B is a cross-sectional view taken along a line IVB-IVB in FIG. 4A.
Figure 4C:
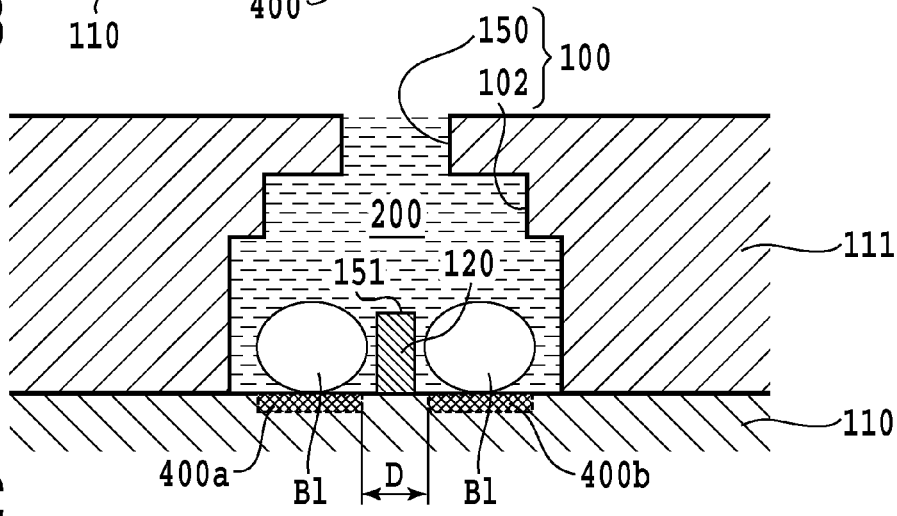
FIG. 4C is a cross-sectional view taken along a line IVC-IVC in FIG. 4A.

The nozzle structure provided for the print head 101 of this embodiment is shown in FIGS. 4A to 4C. FIG. 4A is a cross-sectional view of one of the nozzles 600 constituting the nozzle array of the print head 101, taken in the direction in which ink droplets are ejected (the direction perpendicular to the substrate 110). FIG. 4B is a cross-sectional view taken along a line IVB-IVB in FIG. 4A, and FIG. 4C is a cross-sectional view taken along a line IVC-IVC in FIG. 4A.

The ink flow paths 300 in the print head 101 of this embodiment are extended, so that one end communicates with the common liquid chamber 112 and the other end communicates with the bubble generation chamber 200. Since the ink flow paths 300 are formed in this manner, ink supplied from the ink supply port 500 is temporarily retained in the common liquid chamber 112, and is then distributed to the individual ink flow paths 300. In this manner, ink stored in the ink tank IT is supplied to the individual nozzles 600. The ink flow paths 300 are linearly extended, and have substantially the same widths from the common liquid chamber 112 to the bubble generation chambers 200. In addition, the ink flow direction in which ink is moved along the ink flow paths 300 is perpendicular to the supplying direction in which the ink droplets are ejected from the ejection ports 100.

In this embodiment, the heaters 400 provided for the print head 101 generate thermal energy to be used for ejecting ink, and the ejection ports 100 are formed in the bubble generation chambers 200 to eject ink upon the application of the thermal energy provided by the heaters 400. Further, in each of the bubble generation chambers 200, a partition wall 120, having the shape of a rectangular parallelepiped in this embodiment, is arranged inside the area where the heaters 400 are provided and at a location opposite the ejection ports 100. More specifically, a plurality of heaters 400 are provided inside a bubble generation chamber 200. The heaters 400 are arranged so that the partition wall 120 is positioned inside the area where these heaters 400 are located. In this embodiment especially, two heaters 400 are arranged in one bubble generation chamber 200, and the partition wall 120 is located between the two heaters 400. In a case wherein a plurality of heaters 400 are arranged inside each bubble generation chamber 200, the area where the heaters 400 are located should indicate the area that includes both the areas of the heaters 400 on the surface of the element substrate 110 and the area between the heaters 400. Furthermore, in a case wherein the heaters 400 are formed of one component, as will be described later, the area where the heater 400 is located should indicate the area of the heater on the surface of the element substrate 110.

For description purposes, the two heaters 400 in this embodiment are referred to as heaters 400*a* and 400*b*. The heaters 400*a* and 400*b* are shaped like rectangles, viewed from the ejection direction, extended to the direction from the ink supply port 500 to the bubble generation chamber 200. For convenience sake, from the ink supply port 500 toward the bubble generation chamber 200 is referred to as an ink supply direction.

In this embodiment, wiring 700, for supplying electricity to the heaters 400, is employed to connect the rectangular heaters 400 in series, at their short sides for driving the heaters. In this embodiment, the wiring 700 connects the two heaters 400*a* and 400*b* in series, at their short sides, i.e., a terminal 510*a*, provided for the heater 400*a*, is connected to the wiring 700, while a terminal 510*b*, provided for the heater 400*b*, is connected to the wiring 700. As a result, the heaters 400 are electrically connected to the wiring 700 via the terminals 510. And when the heaters 400*a* and 400*b* are connected in this manner, the heaters 400*a* and 400*b* are driven almost simultaneously, when an electric signal is received, and bubbles are generated at the same time by the heaters 400*a* and 400*b*. Therefore, the loss of bubble shape balance in a bubble generation chamber 200 is prevented, and ink in the bubble generation chamber 200 can flow stably. In addition, since the heaters 400 are connected at their short sides, electricity appropriately flows across the heaters 400*a* and 400*b*, and a difference in the quantity of heat generated by the individual heaters 400 does not occur.

In this embodiment, two heaters 400*a* and 400*b* are located inside a bubble generation chamber 200. However, the arrangement employed for a nozzle for the print head 101 of this invention is not thereby limited, and three or more heaters 400 may be arranged inside a bubble generation chamber 200, and a partition wall 120 may be positioned among these heaters 400. Either this, or only one heater 400 may be located inside each bubble generation chamber 200. In such a case, a partition wall 120 is positioned inside the area wherein the heater 400 is located, and covers part of the heater 400. With this arrangement, the part of the heater 400 that is covered can not efficiently apply thermal energy to ink in the bubble generation chamber 200. However, an advantage afforded by a print head 101 having this arrangement is that the manufacturing process can be simplified.

In this embodiment, the two heaters 400*a* and 400*b* and the bottom face of the partition wall 120, like rectangles, have a long side extended in the same direction. Furthermore, in this embodiment, the long side of the bottom face of the partition wall 120 is substantially equal to or longer than the long side of the heaters 400.

A bubble B1, generated by the heater 400, is shown in FIG. 4B, and the height of the bubble B1 is defined as B1*h*. That is, when the bubble B1, driven by the heater 400, has reached its maximum growth, the distance from the surface of the element substrate 110 to the portion of the bubble B1 farthest from the surface of the element substrate 110 is defined as B1*h*. Further, the distance from the element substrate 110 to a portion of the upper surface of the partition wall 120, measured from the surface of the element substrate 110, is defined as Wh. At this time, it is preferable that the distance Wh, used for the partition wall 120 (used as the height of the partition wall 120), be smaller than the distance B1*h*, used for the bubble B1, and should range from 5 to 10 μm. In this embodiment, a distance Wh of 7 μm is especially preferable. The height of the short side of the cross section of the partition wall 120, taken in the ejection direction, is about half of the distance from the surface of the element substrate 110 to the portion of the partition wall 120 farthest from the surface of the element substrate 110 (the height of the partition wall 120). In addition, it is preferable that a distance Mh from the surface of the element substrate 110 to the wall face of the orifice plate 111, which defines the ink flow path 300, be 10 to 20 μm. In this embodiment, the distance Mh is 14 μm.

Further, in this embodiment, the components of each ejection port 100 are: a first ejection port portion 150, which communicates with the air; and a second ejection port portion 102, which is larger in cross section than the first ejection port portion 150, in a direction perpendicular to the ink ejection direction, and is located between the bubble generation chamber 200 and the first ejection port portion 150.

Figure 5:
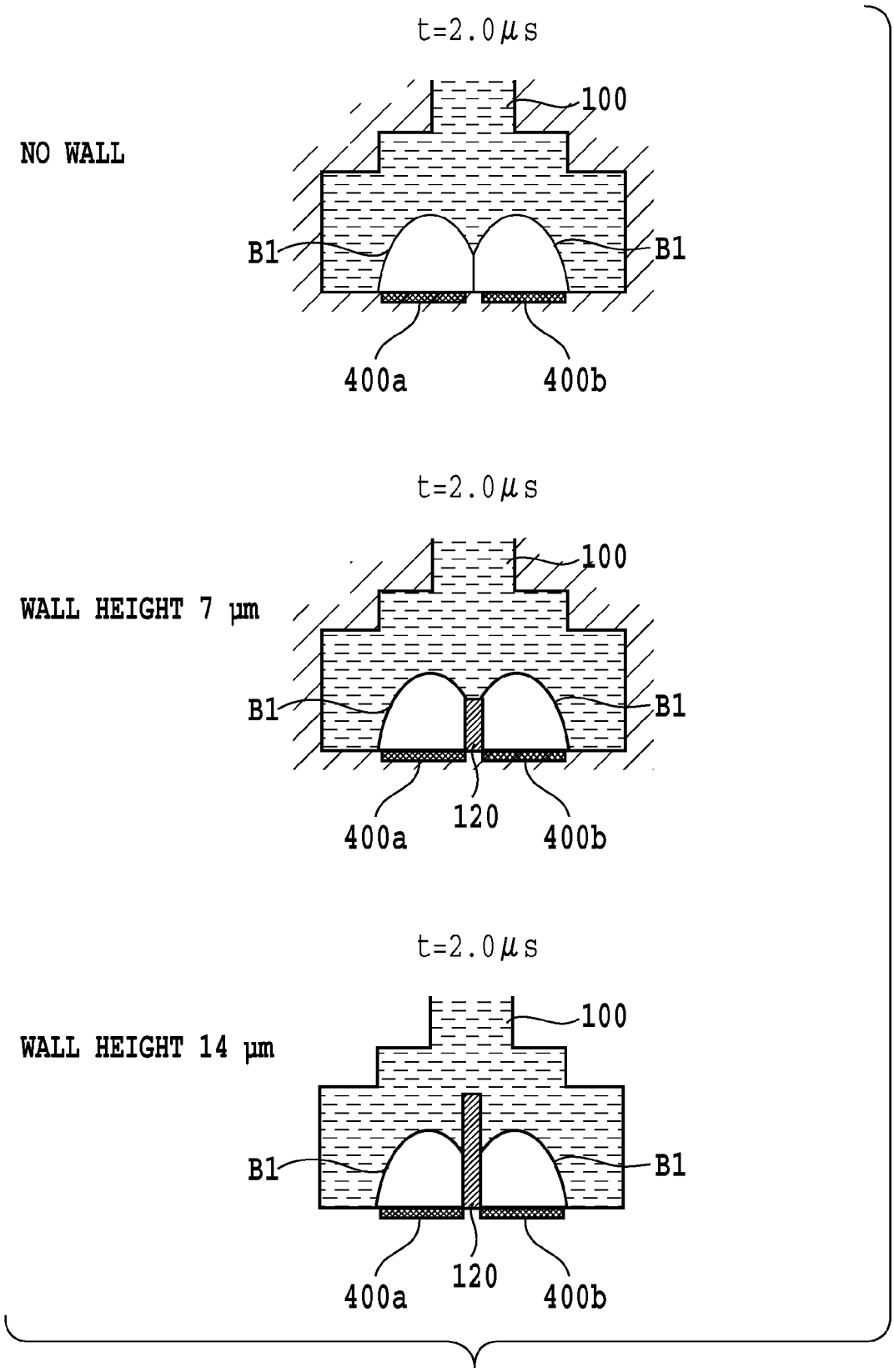
FIG. 5 is an explanatory diagram showing a comparison, at a time t=2.0 μs, of the length of a partition wall in a bubble generation chamber in FIGS. 4A to 4C, from the surface of an element substrate to the air side.

The operating effects obtained by this embodiment will now be described while referring to FIGS. 5, 6 and 7. FIG. 5 is a view, taken in the direction shown in FIG. 4C (the ink supply direction), of the movement of ink through the print head 101 during fluid simulations performed for a case wherein the partition wall 120 is not formed and for cases wherein the distance from the top portion of the partition wall 120 to the surface of the element substrate 110 is 7 μm and 14 μm. The growth of the bubble B1 after 2.0 μs has elapsed is shown in FIG. 5, and at this time, inside the print head 101, the maximum growth of the bubble B1 is reached.

For description purposes, the portion of the partition wall 120 farthest from the element substrate 110 in the ink ejection direction is defined as an air-side portion 151. In this embodiment, the entire face of the partition wall 120, opposite the bottom face that contacts the element substrate 110, is applied as the air-side portion 151. As illustrated in FIG. 5, when 7 μm is set as the distance from the surface of the element substrate 110 to the air-side portion 151 of the partition wall 120, this distance is smaller than the maximum height of the bubble B1. And when 14 μm is set as the distance from the surface of the element substrate 110 to the air-side portion 151 of the partition wall 120, this distance is greater than the maximum height of the bubble B1.

Figure 6:
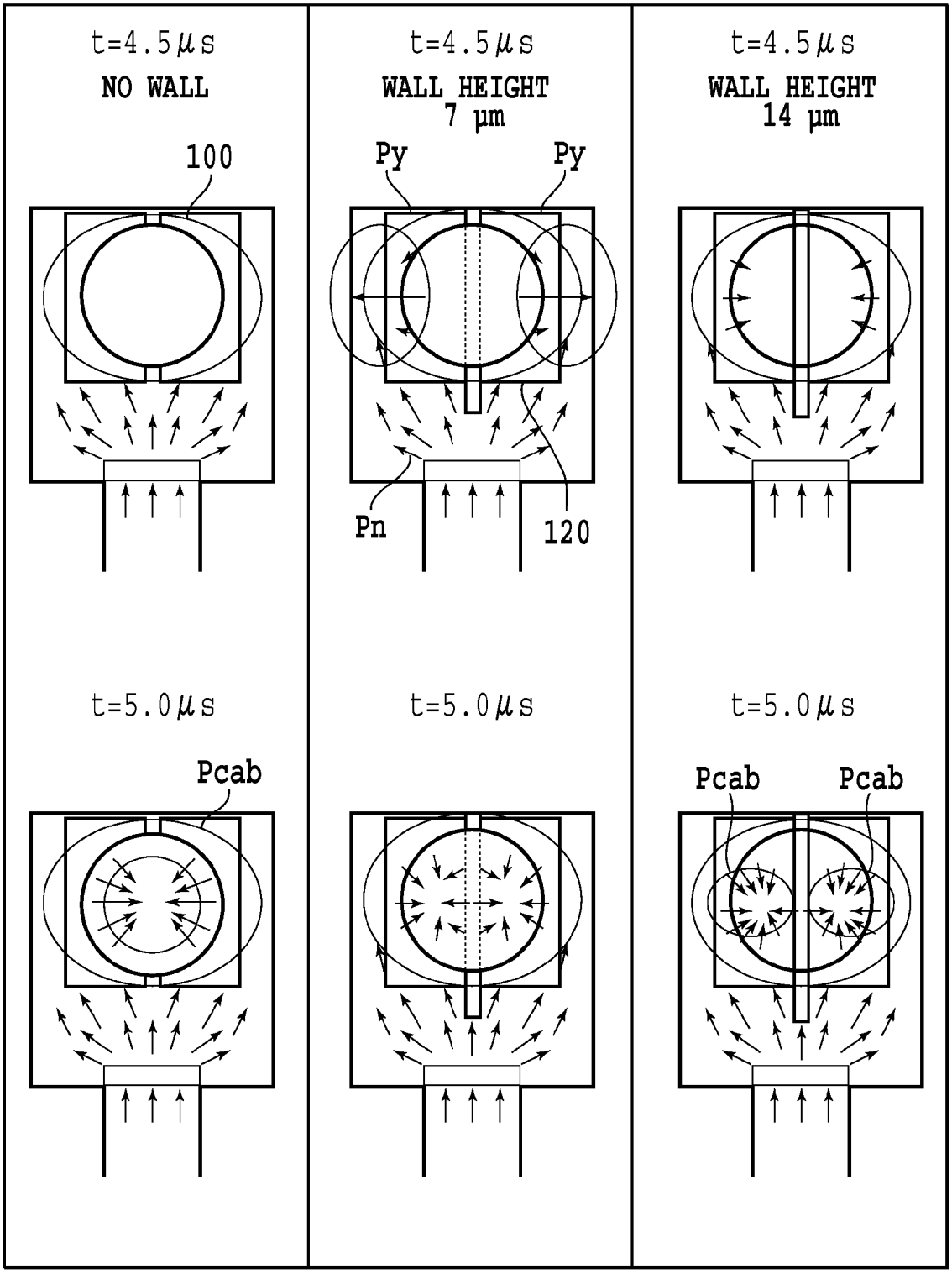
FIG. 6 is a simulation diagram showing a comparison, at t=4.5 and 5.0 μs, of the length of the partition wall from the surface of the element substrate to the air side, when the inside of the bubble generation chamber in FIGS. 4A to 4C is viewed in the ejection direction.

FIG. 6 is a diagram showing the movement of ink inside the print head 101, through a fluid simulation, when the print head 101 is viewed from the ink ejection direction. A pressure vector Pn for a fluid is also shown in FIG. 6. While still referring to FIG. 6, the conditions at time t=4.5 and 5.0 μs since the heaters 400 were put into conductive (or energized) and the state of ink in the print head 101 as the time elapsed are indicated. In this case, a time lag since the heaters 400 were conductive until film boiling occurred on the heaters 400 can be substantially ignored, and the time t elapsed since the heaters 400 were put into conductive can also be regarded as a period since the generation of bubbles was started.

Figure 7:
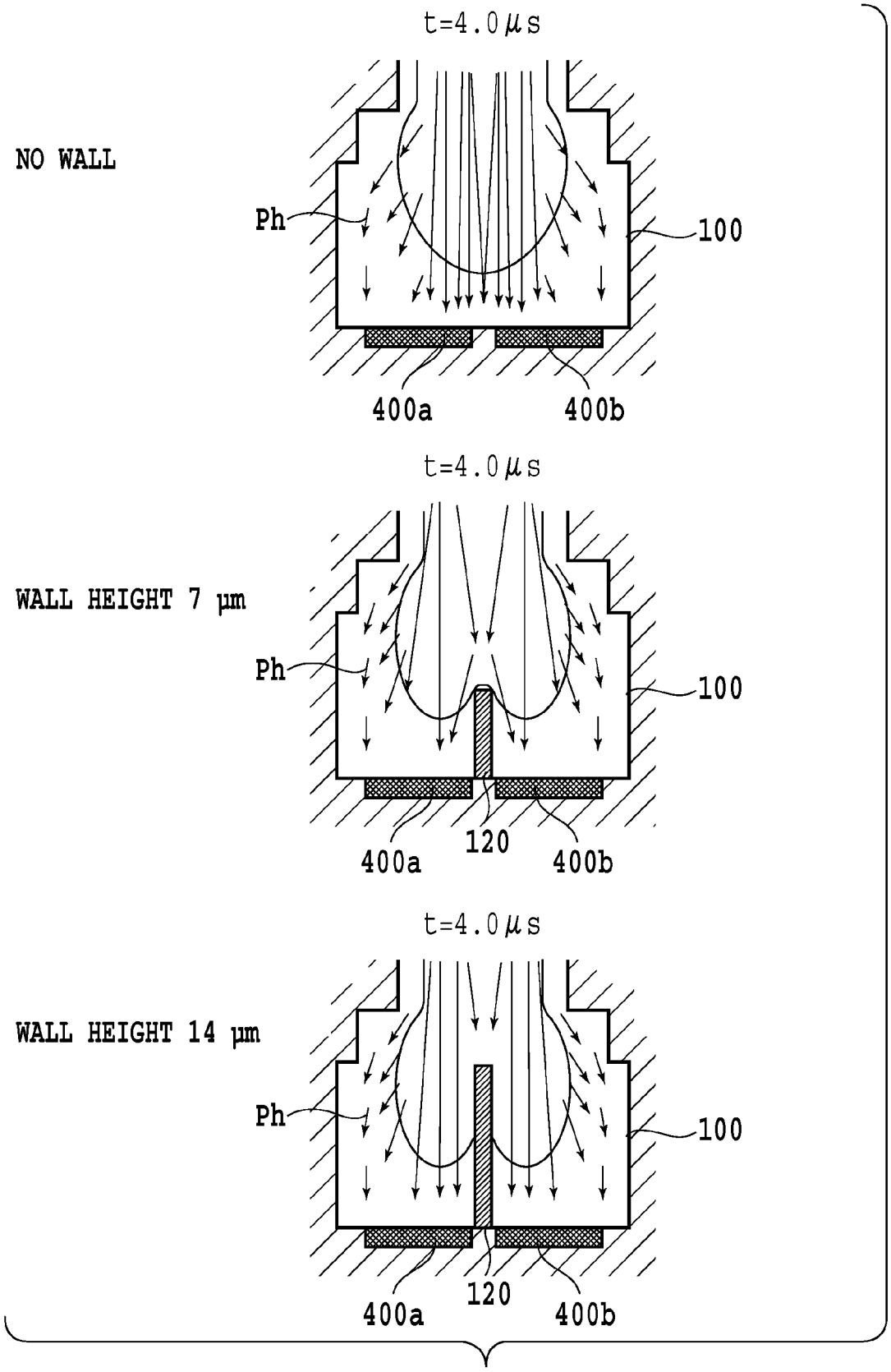
FIG. 7 is a simulation diagram showing a comparison, at t=4.0 μs, of the length of the partition wall from the surface of the element substrate to the air side, when the inside of the bubble generation chamber in FIGS. 4A to 4C is viewed from the side face.

FIG. 7 is a diagram illustrating the movement of ink in a fluid simulation when the print head 101 is viewed from the side, as in FIG. 4C. As well as in FIG. 6, a pressure vector Pn for a fluid in the print head 101 is also shown in FIG. 7. A bubble in FIG. 7 is in a state wherein t=4.0 μs has elapsed since the heaters 400 became conductive.

Referring to FIG. 6, in a case wherein the partition wall 120 is not formed, at the time t=5.0 μs during the bubble collapse, pressure localization Pcab occurred in the center of the heater 400. This is a previously described cavitation that causes the durability of the heater 400 to deteriorate. Further, referring to FIG. 7, in a case wherein the partition wall 120 is not formed, it is found that a comparatively strong pressure wave from the air-side to the surface of the element substrate 110 was generated between the two heaters 400. In addition, it is indicated that a stronger pressure wave is generated at the edges of the heaters 400*a* and 400*b*, and this pressure wave becomes a previously described cavitation source that causes the durability of the heaters 400 to deteriorate.

Compared with a case wherein the partition wall 120 is not formed, in a case wherein there is a distance of 7 μm from the surface of the element substrate 110 to the air-side portion 151 of the partition wall 120, at a time t=4.5 μs during the bubble collapse, a pressure wave that is less localized is distributed. This occurs because, as shown in FIG. 6, a pressure wave Py is generated in a direction perpendicular to the ink supply direction and parallel to the surface of the element substrate 110 (the transverse direction shown in the diagram in FIG. 6).

In a case wherein the partition wall 120 is not present in the bubble generation chambers 200, during the generation and the collapse of bubbles in the bubble generation chambers 200, ink flows from the air to the surface of the element substrate 110 in a direction perpendicular to the surface of the element substrate 110. However, according to the print head 101 of this embodiment, wherein the partition walls 120 are formed inside the bubble generation chambers 200, when ink contacts the partition wall 120, the direction of the flow of ink from the air to the surface of the element substrate 110 is changed. Therefore, the original flow of ink, which flows only in a direction from the air to the surface of the element substrate over the heaters 400, is changed from the partition wall 120 to outside the bubble generation chamber 200, and as a result, an additional directional element is obtained that is perpendicular to the ink supply direction and is parallel to the surface of the element substrate 110. Further, a pressure wave is distributed by this flow of ink that moves from the partition wall 120 to outside the bubble generation chamber 200, in a direction perpendicular to the ink supply direction. As a result, localization of the pressure wave at one position on the heaters 400 is prevented.

Moreover, as shown in FIG. 7, the downward pressure wave is greatly relaxed at the time t=4.0 μs, during the bubble collapse. This is because, since the partition wall 120 changes the direction of a pressure wave that travels from the air side to the surface of the element substrate 110, the directional component of the pressure wave that travels from the air side to the surface of the element substrate 110 is reduced.

In addition, since the heaters 400 are divided into the heaters 400*a* and 400*b* and the partition walls 120 are located inside the individual bubble generation chambers 200, generated bubbles are divided into segments in the bubble generation chambers 200. Therefore, the size of each generated bubble segment is small, and accordingly, the magnitude of the pressure wave localized during the bubble collapse is lowered.

An explanation will now be given for a case wherein 14 μm is employed as the distance from the surface of the element substrate 110 to the air-side portion 151 of the partition wall 120. In this case, during the bubble collapse, a relatively large pressure wave, like the one that occurs in a case wherein 7 μm is employed as the distance between the surface of the element substrate 110 and the air-side portion 151 of the partition wall 120, does not occur in a direction, perpendicular to the ink supply direction, from the partition wall 120 toward the outside of the bubble generation chamber 200. However, a few directional components of ink are still present in the direction perpendicular to the ink supply direction, from the partition wall 120 toward the outside of the bubble generation chamber 200. Therefore, compared with a case wherein the partition wall 120 is not formed, the ink flows over the heaters 400 in an inclined direction, from the air side to the surface of the element substrate 110. Also, as described in a case wherein 7 μm is employed as the distance from the air-side portion 151 of the partition wall 120 to the surface of the element substrate 110, a pressure wave that travels from the air side to the surface of the element substrate 110 is reduced because the bubble is divided into two segments by the partition wall 120. Therefore, the pressure exerted during the bubble collapse is lowered, compared with a print head that does not include a partition wall 120.

Through the above description, it is found that, in all three cases, the pressure wave is least localized for the case wherein 7 μm is the distance between the surface of the element substrate 110 and the air-side portion 151 of the partition wall 120. As a result, the occurrence of cavitation is suppressed, and the durability of the heaters is improved. Further, the occurrence of cavitation is suppressed in the case wherein 14 μm is the distance between the surface of the element 110 and the air-side portion 151 of the partition wall 120. In this case, at the time t=4.0 μs during the bubble collapse, a pressure wave does not occur in a direction, perpendicular to the ink supply direction, from the partition wall 120 to the outside of the bubble generation chamber 200. Since the bubble is divided into two segments by the partition wall 120, the pressure wave that travels from the air side to the surface of the element substrate 110 is dispersed, slightly obliquely. In this case, it is found that, compared with a case wherein the partition wall 120 is not formed, the downward pressure wave is lowered, and as a result, the occurrence of cavitation can be suppressed and the durability of the heaters can be improved.

As described above, since greater effects are obtained when the height of the partition wall 120 is 7 μm than when the height is 14 μm, it is understood that to change the direction of an ink flow, a partition wall 120 having a height of 7 μm is more appropriate than one having a height of 14 μm. Putting aside the internal shape of the bubble generation chamber, a partition wall 120 having a height of 14 μm is too tall to change the direction of ink that flows from the air side to the surface of the element substrate 110 during the bubble collapse.

The effects provided by the above described arrangement are represented using a table in FIG. 8. A fluid vector for the bubble collapse is represented using localization relative to the heater 400 and the intensity of the pressure wave in a direction from the air-side portion 151 to the surface of the element substrate 110. As previously described, based on both the localization of the pressure wave relative to the heater 400 and on the intensity of the pressure wave in a direction from the air side to the surface of the element substrate 110, the greatest effects are obtained for a case wherein 7 μm is the distance from the surface of the element substrate 110 to the air-side portion 151 of the partition wall 120. The second greatest effects are obtained for a case wherein 14 μm is the distance between the surface of the element substrate 110 to the air-side portion 151 of the partition wall 120. It should be noted that, as described in "Description of the Related Arts", the distance between the two heaters 400 should be as small as possible, and accordingly, as thin a partition wall 120 as possible is required in order to position it between two heaters. However, when the partition wall 120 is too thin, or when the aspect ratio of the partition wall 120 is extremely large, the partition wall 120 could collapse due to its lack of strength. Therefore, based on the experimental results, it is found that a thickness of 2.5 to 5 μm and an aspect ratio of two or smaller are actually preferable for the partition wall 120, and that 5 to 10 μm is an appropriate height. Furthermore, it is preferable that the ink flow paths 300 be about as high as a bubble, and that at the location where the ink flow paths 300 communicate with the bubble generation chambers 200, 10 to 20 μm is appropriate for the cross-sectional length of the communicating portion of each of the ink flow paths 300 in the ink ejection direction (the height of the ink flow path 300). In this embodiment, not only are the portions of the ink flow paths 300 that communicate with the bubble generation chambers 200 extended, but the ink flow paths 300 are extended in their entirety, while the height of 10 to 20 μm is maintained. It is also preferable that the distance (the height of the partition wall 120) between the surface of the element substrate 110 and the portion of the partition wall 120 farthest from the surface of the element substrate 110 be almost half the height of the ink flow paths 300.

Further, when a distance D between the heaters 400 in the same nozzle is larger than the diameter of an ejection port, an eject failure may occur. Therefore, it is preferable that the distance D between the heaters 400 be smaller than the diameter of an ejection port.

Even when the above described partition wall 120 is formed, the length of the partition wall 120, in the direction in which the ink flow paths 300 are extended (ink supply direction), if the length of the partition wall 120 is substantially equal to the length of the heater 400, the straight forward flight of ink is less adversely affected. Further, in this embodiment, the partition wall 120 is symmetrically located along the center axis between the two heaters 400 in the direction of the nozzle array, and the interval between the heaters 400 is relatively small, so that the straight forward flight of ink is less adversely affected. For these facts, it was confirmed, by performing the above described fluid simulation, that a satisfactory straight forward flight is maintained for ejected satellites.

When the print head 101 of this embodiment is employed to eject ink, the communication of bubbles with air is not required to improve the durability of the print head by reducing the occurrence of cavitation. As described above, during the bubble collapse, the intensity of the localization of pressure in a bubble generation chamber can be reduced, even when the bubble does not communicate with air. Therefore, ink can be ejected without degrading the accuracy with which ink droplets land, and the durability of the print head 101 can be increased. In addition, since the occurrence of cavitation can be reduced without a specific limitation being placed on the shape of the nozzles 600, the nozzles 600 can be easily designed, and the cost of manufacturing the print head 101 can be reduced.

Second Embodiment

A print head according to a second embodiment of the present invention will now be described while referring to FIGS. 9A to 9C. In the second embodiment, the same reference numerals as used in the first embodiment are provided for corresponding components, and no further description will be given for them. Only different portions will now be described.

Figure 9A:
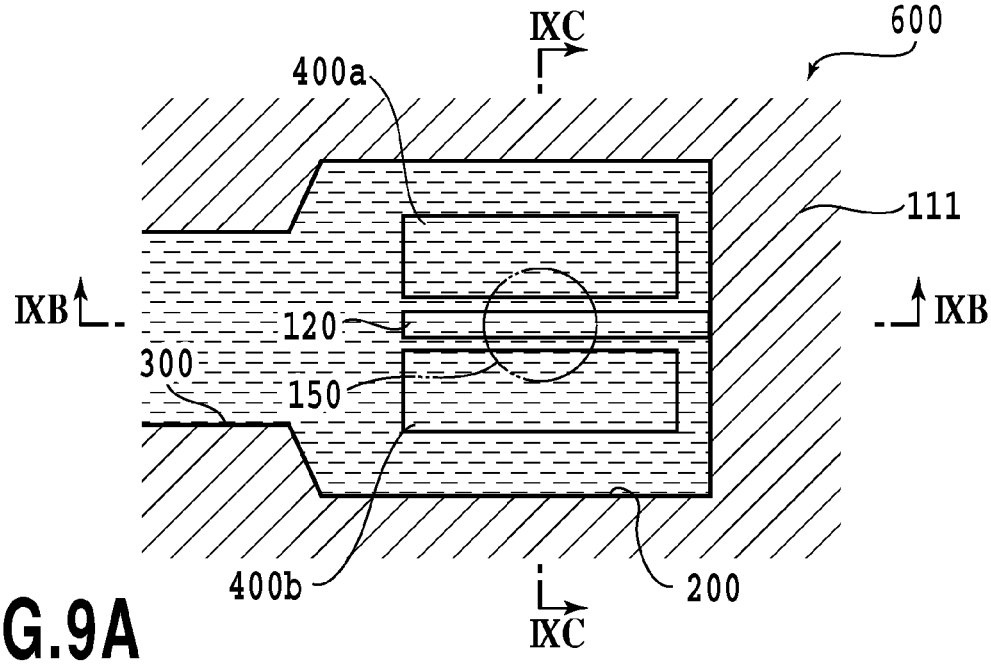
FIG. 9A is an enlarged cross-sectional view, taken in an ejection direction, of the essential portion of a print head according to a second embodiment of the preset invention.
Figure 9B:
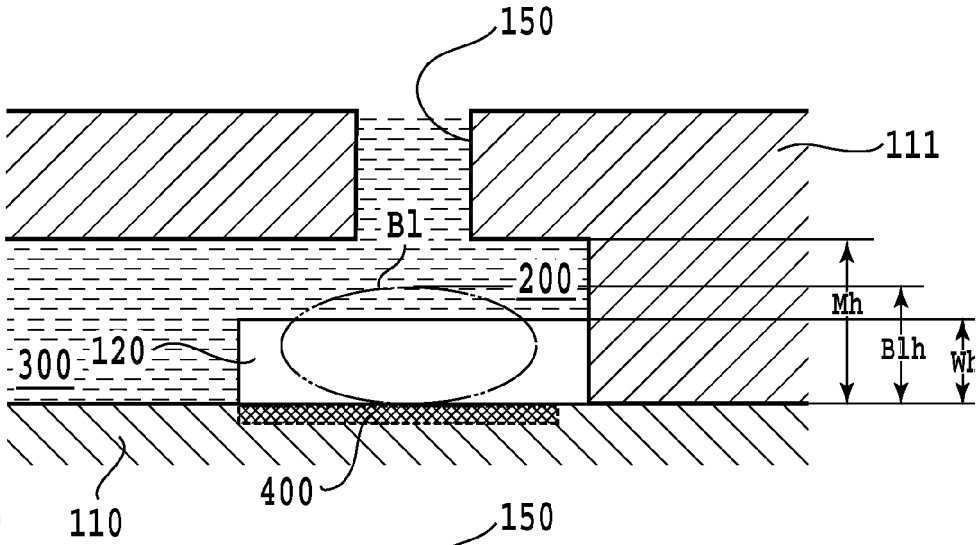
FIG. 9B is a cross-sectional view taken along a line IXB-IXB in FIG. 9A.
Figure 9C:
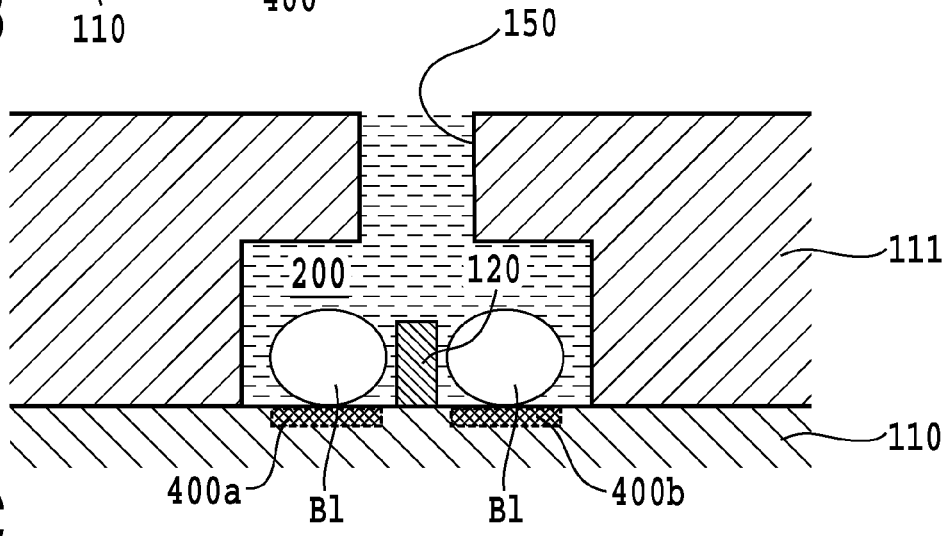
FIG. 9C is a cross-sectional view taken along a line IXC-IXC in FIG. 9A.

The nozzle structure of the print head of the second embodiment is shown in FIGS. 9A to 9C. FIG. 9A is a cross-sectional view of one of multiple nozzles of the print head of the second embodiment, taken in a direction vertical to a substrate, i.e., in an ink ejection direction. FIG. 9B is a cross-sectional view taken along a line IXB-IXB in FIG. 9A, and FIG. 9C is a cross-sectional view taken along a line IXC-IXC in FIG. 9A.

In the first embodiment, the component parts of each of the ejection ports 100 are: the first ejection port portion 150, which communicates with air; and the second ejection port portion 102, which is larger in cross section than the first ejection port portion 150, in a direction perpendicular to the ejection direction, and is located between the bubble generation chamber 200 and the first ejection port portion 150. Ejection ports 100 of the second embodiment differ from those in the first embodiment in that, between the air and a bubble generation chamber 200, only a first ejection port portion 150 is formed that communicates with the air. As described above, and as shown in FIGS. 9A to 9C, only the first ejection port portions 150 may be formed as the ejection ports 100 for the print head.

Third Embodiment

A print head according to a third embodiment of the present invention will now be described while referring to FIGS. 10A to 10C. In the third embodiment, the reference numerals used in the first and second embodiments are also provided for corresponding components, and no further description for them will be given. Only a different portion will now be described.

Figure 10A:
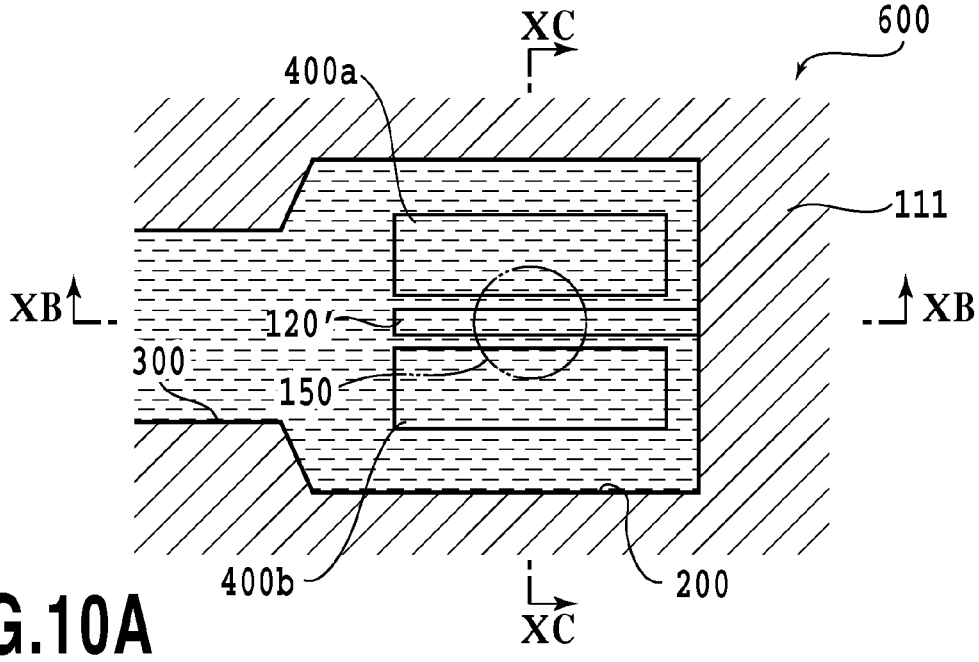
FIG. 10A is an enlarged cross-sectional view, taken in an ejection direction, of the essential portion of a print head according to a third embodiment of the preset invention.
Figure 10B:
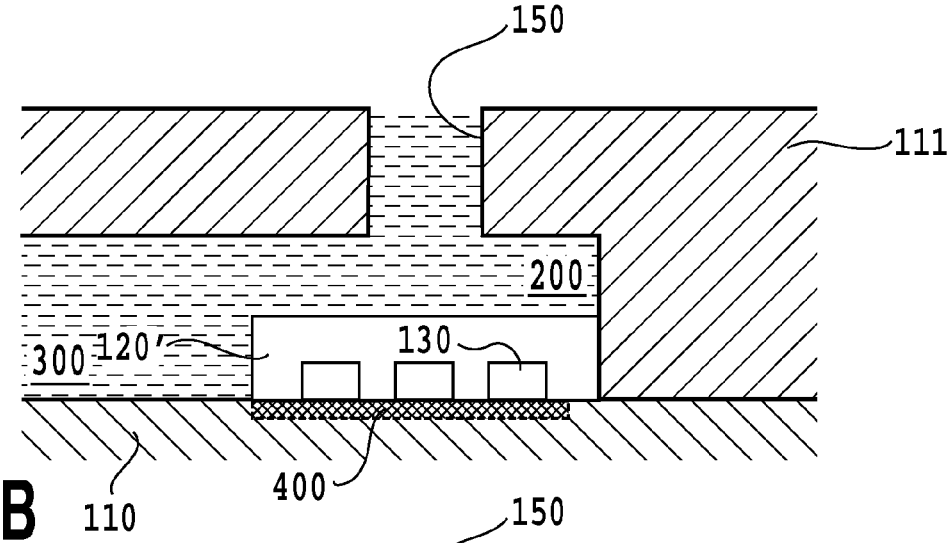
FIG. 10B is a cross-sectional view taken along a line XB-XB in FIG. 10A.
Figure 10C:
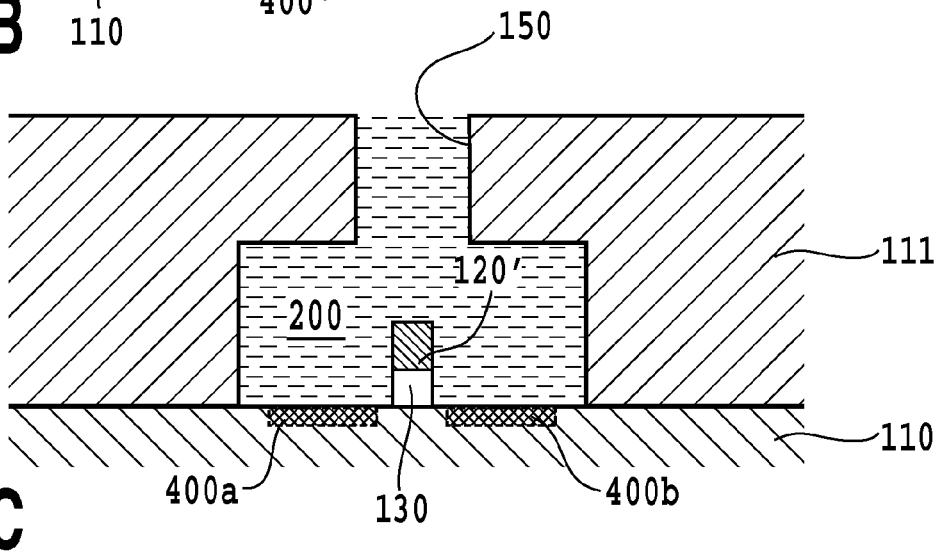
FIG. 10C is a cross-sectional view taken along a line XC-XC in FIG. 10A.

The nozzle structure of the print head of the third embodiment is shown in FIGS. 10A to 10C. FIG. 10A is a cross-sectional view of one of multiple nozzles of the print head of the third embodiment, taken in a direction vertical to a substrate, i.e., in an ink ejection direction. FIG. 10B is a cross-sectional view taken along a line XB-XB in FIG. 10A, and FIG. 10C is a cross-sectional view taken along a line XC-XC in FIG. 10A.

In the first and second embodiments, the partition walls 120, which are shaped like solid rectangular columns, are formed inside the bubble generation chambers 200 of the print head 101. In this embodiment, communication ports 130 are formed through part of a partition wall 120', near an element substrate 110, so that the space around a heater 400*a* is connected to the space around a heater 400*b*. Especially in this embodiment, the communication ports 130 are formed so they are exposed to the surface of the element substrate 110. When the communication ports 130 are formed through the partition wall 120' in this manner, the distribution of ink is enabled between the space around the heater 400*a* and the space around the heater 400*b*. Therefore, the flowability of ink can be increased, and using the flow of ink, the pressure wave produced by the collapse of a bubble can be efficiently dispersed. Further, the ink pressure that is exerted against the partition wall 120' during the expansion or the shrinking of a bubble can be released via the communication ports 130, and the peeling of the partition wall 120' can be prevented.

Fourth Embodiment

A print head according to a fourth embodiment of the present invention will now be described while referring to FIGS. 11A to 11C. In the fourth embodiment, the reference numerals used in the first to the third embodiments are provided for corresponding components, and no further description for them will be given. Only a different portion will now be described.

Figure 11A:
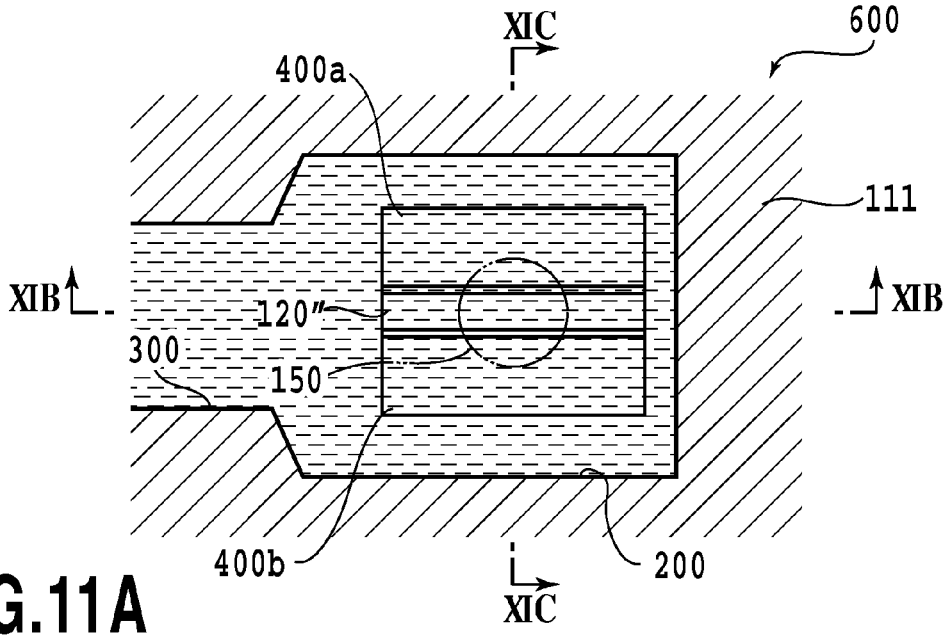
FIG. 11A is an enlarged cross-sectional view, taken in an ejection direction, of the essential portion of a print head according to a fourth embodiment of the preset invention.
Figure 11B:
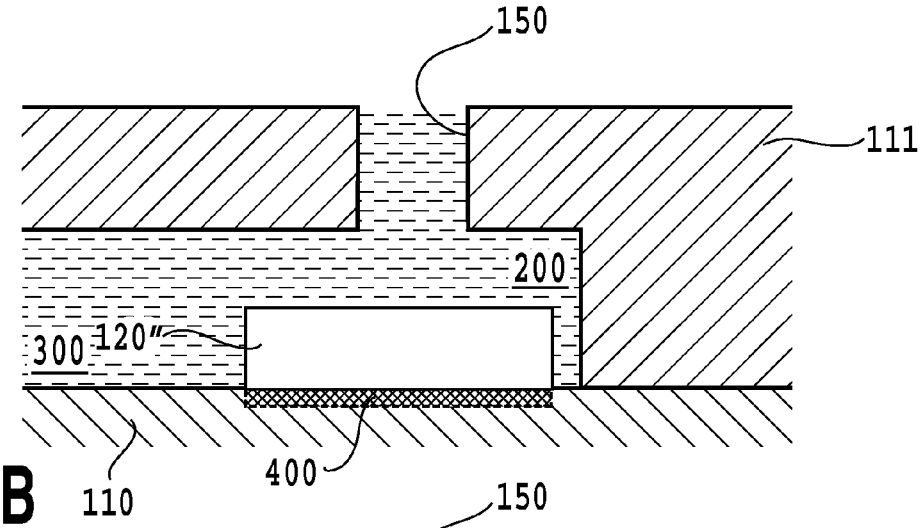
FIG. 11B is a cross-sectional view taken along a line XIB-XIB in FIG. 11A.
Figure 11C:
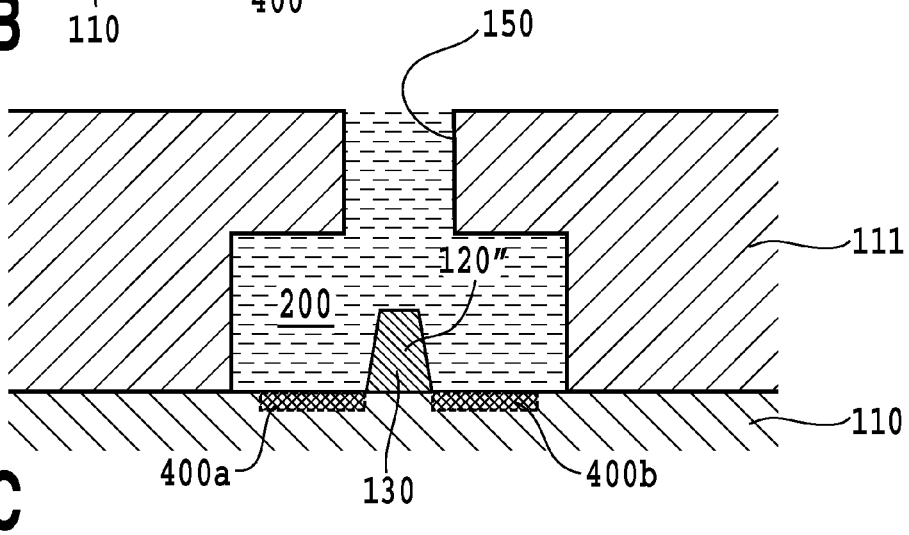
FIG. 11C is a cross-sectional view taken along a line XIC-XIC in FIG. 11A.

The nozzle structure of the print head of the fourth embodiment is shown in FIGS. 11A to 11C. FIG. 11A is a cross-sectional view of one of multiple nozzles in the print head of the fourth embodiment, taken in a direction vertical to a substrate, i.e., in an ink ejection direction. FIG. 11B is a cross-sectional view taken along a line XIB-XIB in FIG. 11A, and FIG. 11C is a cross-sectional view taken along a line XIC-XIC in FIG. 11A.

In the first to the third embodiments, the cross-sectional shape of the partition wall 120 taken along the line XIC-XIC is rectangular, and the length of the partition wall 120 on the element substrate 110 side is equal to the length on the ejection port 100 side. In the fourth embodiment, as shown in FIG. 11C, a partition wall 120" for a print head has a trapezoidal shape in cross section, taken along a line XIC-XIC, and the length on the element substrate 110 side is longer than the length on the ejection port side 100.

Therefore, the partition wall 120" has slopes that are inclined from the air side to the surface of the element substrate 110. Therefore, when a bubble collapses and when ink flows from the air side to the surface of the element substrate 110 and contacts the partition wall 120", a greater change can be made in the direction of the ink flow. As a result, after the ink flow has contacted the partition wall 120", the ink flow can include more directional components that travel in a direction, perpendicular to the ink supply direction, from the partition wall 120" to the outside of a bubble generation chamber 200. Since in this manner a larger ink flow can be generated in a direction, perpendicular to the ink supply direction, from the partition wall 120" to the outside of the bubble generation chamber 200, and the pressure wave, usually localized to on one portion of a heater 400, can be more effectively dispersed. Further, for the partition walls 120 and 120' in the previous embodiments, the long side in the rectangular cross section is employed as the air-side length, whereas for the partition wall 120" of this embodiment, the short side in the trapezoidal cross section is employed as the air-side length. Therefore, since the partition wall 120" of this embodiment contacts a larger area of the element substrate 110 and can be securely fixed thereto, peeling of the partition wall 120" can be prevented when bubbles are expanded and shrunk. In addition, in the bubble generation chamber 200, space at the rear is provided in order to permit ink to pass between the spaces around a heater 400*a* and a heater 400*b*. Thus, the pressure exerted by ink can be scattered, and peeling of the partition wall 120" from the element substrate 110 can be prevented. Furthermore, since the flowability of ink is improved, the ink that flows, in a direction perpendicular to the ink supply direction, from the partition wall 120" to the outside of the bubble generation chamber 200 can be employed to disperse the pressure wave that tends to be localized at one portion of the heater 400.

Fifth Embodiment

A print head according to a fifth embodiment of the present invention will now be described while referring to FIG. 12. In the fifth embodiment, the same reference numerals as used in the first to the fourth embodiments are provided for corresponding components, and no further description will be given for them. Only a different portion will now be described.

Figure 12:
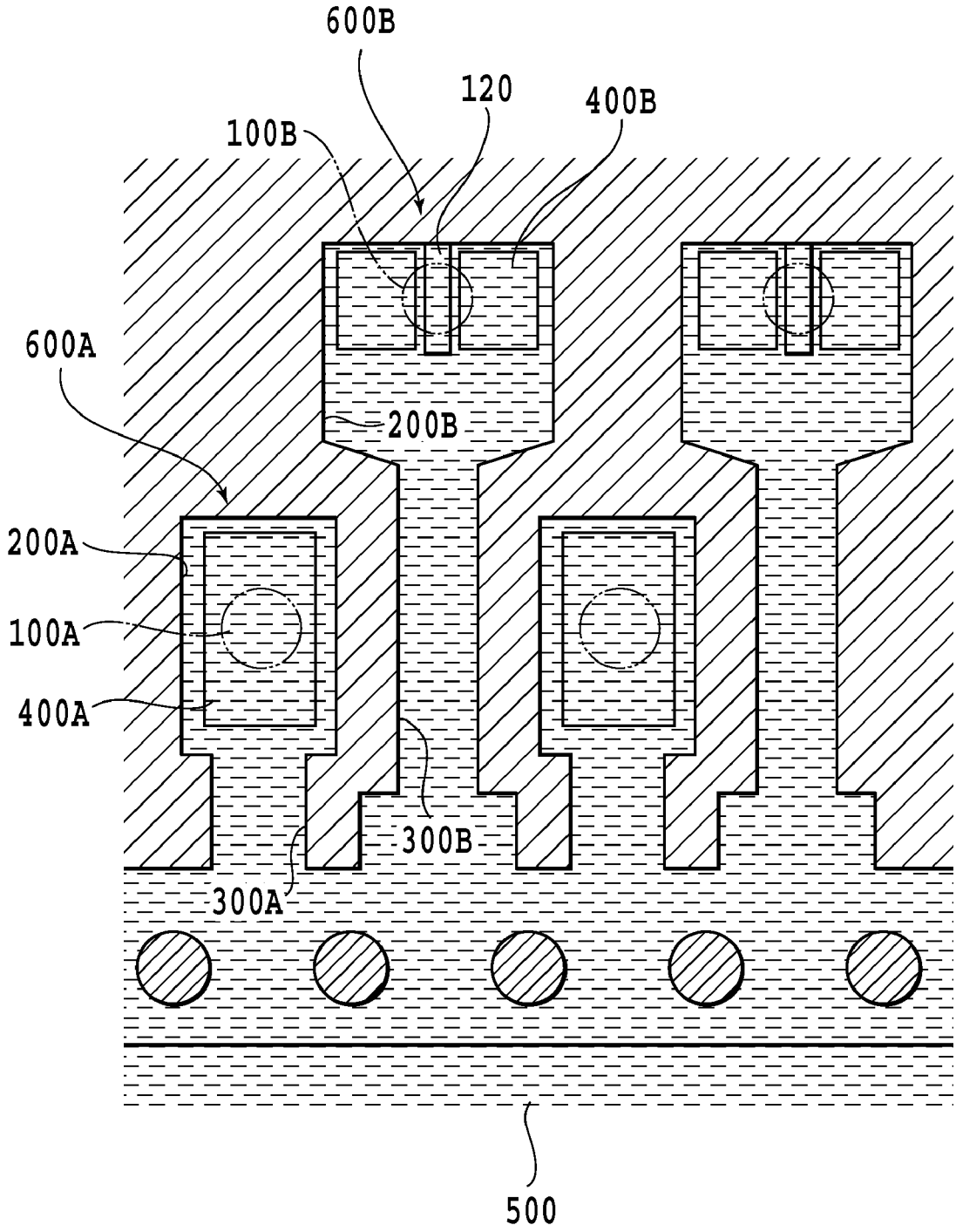
FIG. 12 is an enlarged cross-sectional view, taken in an ejection direction, of the essential portion of a print head according to a fifth embodiment of the preset invention.

The nozzle structure of the print head of the fifth embodiment is shown in FIG. 12. FIG. 12 is a cross-sectional view of four of the multiple nozzles of the print head of the fifth embodiment, taken in a direction vertical to a substrate, i.e., in an ink ejection direction.

For the print head 101 of the first to the fourth embodiments, a plurality of nozzle arrays have been provided by arranging the nozzles 600 at the same distances from the ink supply port 500. In this embodiment, nozzle arrays are formed by alternately arranging first nozzles 600A, located at a comparatively short distance from an ink supply port 500, and second nozzles 600B, located at a comparatively long distance from the ink supply port 500. Therefore, the ejection port arrays in this embodiment include: first ejection ports 100A, located at a comparatively short distance from the ink supply port 500; and second ejection ports 100B, located at a comparatively long distance from the ink supply port 500. The first ejection ports 100A and the second ejection ports 100B are alternately arranged in a zigzag pattern. Partition walls 120 are formed inside bubble generation chambers 200 for, at the least, either the first nozzles 600A, which include the first ejection ports 100A, or the second nozzles 600B, which include the second ejection ports 100B, at positions that face the ejection ports. In this embodiment, the partition walls 120 are formed inside the bubble generation chambers 200B of the second nozzles 600B, which are located at a comparatively long distance from the ink supply port 500.

Further, in this embodiment, two rectangular heaters 400B are provided for each of the bubble generation chambers 200B formed for the nozzles 600B that are located comparatively far from the ink supply port 500, and a partition wall 120 is located between each set of two heaters 400B. When the short sides of the two heaters 400B, arranged for the nozzles 600B located comparatively far from the ink supply port 500, are added to the distance between the two heaters 400B, the sum is equal to or greater than half the pitch for the ejection ports 100B of the nozzles 600B.

As described above, the nozzle arrays, which are formed in a zigzag pattern, include the nozzles 600A, located at a comparatively short distance from the ink supply port 500, and the nozzles 600B, located at a comparatively long distance from the ink supply port 500. When the shapes for the inwardly located nozzles 600A are determined, no degree of freedom remains for the nozzle structure used for the outside nozzles 600B, while taking into account the strengths of the nozzle arrays and the relationship between image definition and nozzle density. As a result, the size of a bubble can not be controlled by changing the shape of a nozzle, and the occurrence of cavitation can not be prevented. Therefore, for such zigzag arrays of nozzles, conventional problems affecting the nozzles are that cavitation occurs frequently and that the durability of heaters is deteriorated. However, when the print head 101 of this embodiment is employed for the outside nozzles 600B, the occurrence of cavitation can be prevented without having to change the shape of the nozzles 600B.

As described above, according to this embodiment, the inside nozzles 600A, located nearer the ink supply port 500, are shaped to avoid the occurrence of cavitation and to permit bubbles to contact the air, and the partition walls 120 are formed only for the outside nozzles 600B, which are located further from the ink supply port 500. Since the partition walls 120 are provided only for the nozzles located farthest from the ink supply port 500, i.e., the partition walls 120 are formed only for the nozzles that need partition walls, the manufacture of the print head 101 can be performed efficiently. Furthermore, the arrangements provided for the previous embodiments may also be employed with the arrangement provided for this embodiment.

Further, a partition wall can be formed by using a method, as described, for example, in Japanese Patent Laid-Open No. 2003-127399, whereby a transparent negative resin layer having the same composition as an orifice substrate is applied to the substrate, and is exposed to UV light to form a desired pattern. In addition, by repeating this process, a partition wall having communication ports, as illustrated for the third embodiment, can also be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-316436, filed Dec. 6, 2007, which is hereby incorporated by reference herein in its entirety.

What is claimed is:

1. A liquid ejection head comprising:

a substrate in which a plurality of heat generation elements for generating thermal energy used for ejecting a liquid are arranged at a surface;

a flow path supplying liquid to be ejected;

an energy application chamber formed by i) the surface of the substrate in which at least one of the heat generation elements is arranged and ii) a chamber wall provided on the surface of the substrate and including a communication portion through which the flow path and the energy application chamber are in communication with each other on the surface of the substrate;

an ejection port portion including an ejection port for ejecting the liquid to which thermal energy is applied by the at least one heat generation element, formed at a position opposite to the heat generation element, and the ejection port portion enabling communication between the ejection port and the energy application chamber; and a partition wall, formed at a position opposite to the ejection port, at least partially formed inside of an area, in which the at least one heat generation element is arranged, on the surface of the substrate, wherein a distance from the surface of the substrate to a farthest position of the partition wall from the surface of the substrate is at least substantially half the height of the energy application chamber in a liquid ejection direction in which the liquid is ejected, and is no more than the height of the energy application chamber in the liquid ejection direction, and wherein no wall is arranged between the chamber wall and the partition wall.

2. A liquid ejection head according to claim 1, wherein more than one of the plurality of heat generation elements are arranged in the energy application chamber, and wherein the partition wall is located inside an area within which the plurality of heat generation elements are arranged.

3. A liquid ejection head according to claim 1, wherein two of the plurality of heat generation elements are arranged in the energy application chamber, so that the partition wall is located between the two heat generation elements.

4. A liquid ejection head according to claim 3, wherein the two heat generation elements and a bottom face of the partition wall have rectangular shapes, respectively, the long sides of the heat generation elements and the bottom face of the partition wall being extended in the same direction; and wherein the long side of the bottom face of the partition wall is substantially equal to or greater in length than the long sides of the two heat generation elements.

5. A liquid ejection head according to claim 1, wherein the distance between the surface of the substrate and the position of the partition wall farthest from the surface of the substrate is almost half the height of the energy application chamber in the liquid ejection direction.

6. A liquid ejection head according to claim 1, wherein the distance between the surface of the substrate and the position of the partition wall farthest from the surface of the substrate is 5 to 10 μm;

wherein the partition wall is shaped like a rectangular parallelepiped; and wherein a length of a short side of the partition wall, taken in cross-section along the liquid ejection direction, is almost half the distance between the surface of the substrate and the position of the partition wall farthest from the surface of the substrate.

7. A liquid ejection head according to claim 3, wherein a plurality of ejection ports are arranged to form ejection port arrays;

wherein a liquid supply port used to supply the liquid through the flow path to the energy application chamber is provided, and the liquid supply port has a long side in a direction in which the ejection port arrays are extended, and a short side in a direction perpendicular to the direction in which the ejection port arrays are extended;

wherein the heat generation elements have a long side extended in a direction in which the short side of the liquid supply port is extended; and wherein a distance between the two heat generation elements is smaller than a diameter of each of the ejection ports.

8. A liquid ejection head according to claim 1, wherein a liquid supply port used to supply the liquid through plural flow paths to plural energy application chambers is provided;

wherein a plurality of ejection ports are arranged to form ejection port arrays, the ejection port arrays including first ejection ports, located at a comparatively short distance from the liquid supply port, and second ejection ports, located at a comparatively long distance from the liquid supply port, the first ejection ports and the second ejection ports being alternately arranged in a zigzag pattern; and wherein the partition wall is located inside an area at a position opposite to each of the second ejection ports in the energy application chambers.

9. A liquid ejection head according to claim 1, wherein more than one of the plurality of the heat generation elements are provided in the energy application chamber, and the partition wall is positioned inside an area wherein the heat generation elements are arranged;

wherein the heat generation elements are rectangular in shape; and wherein wiring is extended to connect short sides of the plurality of heat generation elements in series, so that electricity is fed to the heat generation elements that are to be driven.

10. A printing apparatus for performing printing using a liquid ejection head that comprises:

a substrate in which a plurality of heat generation elements for generating thermal energy used for ejecting a liquid are arranged at a surface;

a flow path supplying liquid to be ejected;

an energy application chamber formed by i) the surface of the substrate in which at least one of the heat generation elements is arranged and ii) a chamber wall provided on the surface of the substrate and including a communication portion through which the flow path and the energy application chamber are in communication with each other on the surface of the substrate;

an ejection port portion including an ejection port for ejecting the liquid to which thermal energy is applied by the at least one heat generation element, formed at a position opposite to the heat generation element, and the ejection port portion enabling communication between the ejection port and the energy application chamber; and a partition wall, formed at a position opposite to the ejection port, at least partially formed inside of a region, in which the at least one heat generation element is arranged, on the surface of the substrate, wherein a distance from the surface of the substrate to a farthest position of the partition wall from the surface of the substrate is at least substantially half the height of the energy application chamber in a liquid ejection direction in which the liquid is ejected, and is no more than the height of the energy application chamber in the liquid ejection direction, and wherein no wall is arranged between the chamber wall and the partition wall.

11. A liquid ejection head according to claim 1, wherein the energy application chamber is rectangular, and the chamber wall surrounds three sides of the energy application chamber.

* * * * *